US006073313A

United States Patent [19]

Lasenga et al.

[11] Patent Number: 6,073,313

[45] Date of Patent: Jun. 13, 2000

[54] INTERMEDIATE CARD AND A WEB-PRODUCTION PROCESS

[75] Inventors: Werner Lasenga; Jürgen Andermann, both of Dülmen, Germany

[73] Assignee: Spinnbau GmbH, Germany

[21] Appl. No.: 08/973,985

[22] PCT Filed: Jun. 18, 1996

[86] PCT No.: PCT/EP96/02622

§ 371 Date: Mar. 23, 1998

§ 102(e) Date: Mar. 23, 1998

[87] PCT Pub. No.: WO97/00984

PCT Pub. Date: Jan. 9, 1997

[30] Foreign Application Priority Data

Jun. 20, 1995 [DE] Germany ..... 195 21 778

[51] Int. Cl.[7] ..... D01G 15/02

[52] U.S. Cl. ..... 19/99; 19/98; 19/106 R

[58] Field of Search ..... 19/98, 99, 106 R, 19/112

[56] References Cited

U.S. PATENT DOCUMENTS

| | | | |
|---|---|---|---|
| 656,403 | 8/1900 | Gessner | 19/98 |
| 2,987,779 | 6/1961 | Kawashima | 19/106 R |
| 4,299,011 | 11/1981 | Rothen et al. | 19/106 R |
| 5,226,214 | 7/1993 | Napolitano | 19/98 |

*Primary Examiner*—John J. Calvert
*Assistant Examiner*—Gary L. Welch
*Attorney, Agent, or Firm*—Knechtel, Demeur & Samlan

[57] ABSTRACT

A method and apparatus for producing a web of non-woven fibrous material which is cross-linked in the carding step by means of an intermediate card. There is a main cylinder with two web forming rollers engaging the main cylinder, each taking off one card web. One of the web forming rollers is a random roller for producing a random orientation of the card web. The random roller has associated with it a trough plate with a space between the roller and plate. The space tapers toward the discharge end resulting in stuffing or compression on the web until the web exits to a free non-woven forming zone. Two card webs form a single web, which is taken off the card.

22 Claims, 5 Drawing Sheets

INTERMEDIATE CARD AND A WEB-PRODUCTION PROCESS

Figure 1:
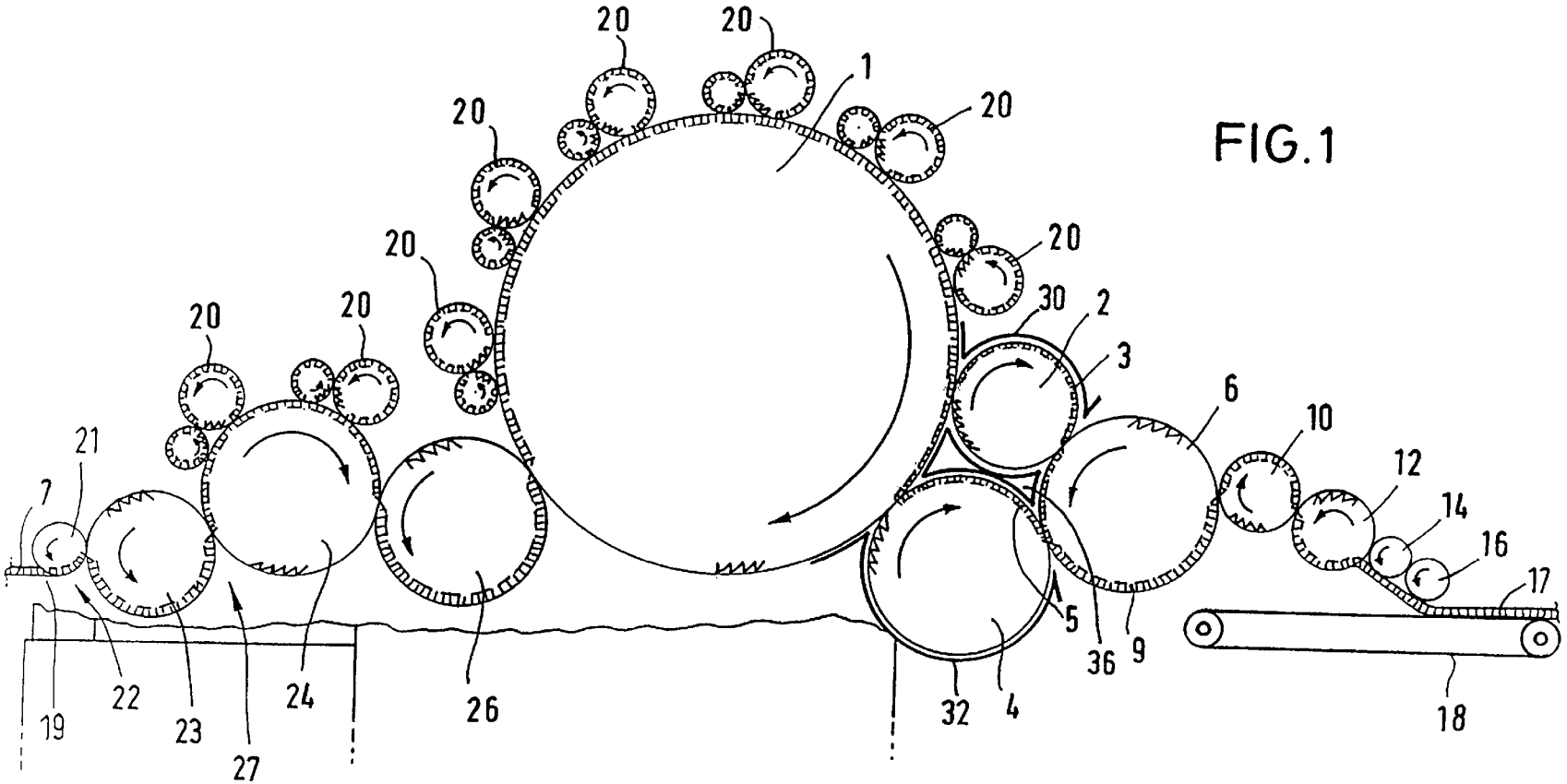

The invention refers to an intermediate card for producing a nonwoven of fibrous material, with a main cylinder, with two web-forming rollers being in engagement with the main cylinder, with at least two card webs being taken off the main cylinder and being doubled by a take-off device.

The invention further refers to a method for producing a nonwoven of fibrous material by means of an intermediate card of the kind mentioned above by carding the fibrous material on a main cylinder, taking off at least two card webs from the main cylinder by means of at least two rollers independent of each other, and by joining the webs on a common roller to form a cross-linked card web.

From EP 0 330 750 A2, there is known an intermediate card for a random laid nonwoven with at least three worker rollers rotating in the same sense as the main cylinder, in which the first working cylinder is in engagement with the main cylinder while the two further working rollers each are in engagement with the first working roller. The two rollers downstream thereof in engagement with the first working roller cause a division of the card web being formed by the first working roller, the card webs being redoubled on transport belts downstream thereof.

Furthermore, there are known carding assemblies of the Hergeth Hollingsworth company (card model H 6.345) in which two random rollers are in engagement with a main cylinder, each producing a random laid web finally laid down on one transport belt each. The doubling of the two random laid webs occurs by joining the two webs on the transport belt.

The nonwoven thus produced consists of two web layers disadvantageously lying on top of each other only in a loose manner and not being cross-linked. An interconnection of the layers only occurs in one or more processing steps subsequent to the carding.

The invention is based on the objective to produce an intermediate card of the latter kind as well as a method for producing a nonwoven wherein the nonwoven produced is already cross-linked in the carding step and wherein the production process, especially in the case of light webs and high production speeds, can be controlled in a better way and wherein the constructive requirements for the production machine are reduced.

This objective is achieved by the characteristics of claims 1 and 17, respectively.

The invention provides, in an advantageous manner, that at least one of the web-forming rollers arranged between the main cylinder and the take-off device is a random roller with an associated centrifugal trough and with fittings for producing a random orientation of the card web.

Such an intermediate card allows to join and simultaneously cross-link multiple webs in the carding step downstream of the web-forming rollers and upstream of the take-off device. Another advantage is the fact that overlaying web fabrics can be produced which are a combination of at least one random laid web and a longitudinally directed nonwoven. Thus, a closely cross-linked card web can be produced. The randomly laid nonwoven is formed in combination with a centrifugal trough and fittings with a small front rake. The randomly laid nonwoven is formed by means of a centrifugal trough in a centrifugal dynamic manner, the web initially being subjected to a stuffing effect and then being freed from the dynamic or stuffing pressure. Thus, the formation of the randomly laid nonwoven occurs after the fibers have been freed from the dynamic effect of the random roller on a subsequent roller. The orientation of the fibers in the nonwoven is three-dimensional, i. e. random or isotropic.

Downstream of the doffer roller, only a single take-off device and a single transport belt are required. In this manner, the constructive requirements for producing doubled card webs are reduced, while the production process, especially in the case of. light webs and a high production speed, can be controlled in a better way.

The circumferential speed of the main cylinder is more than 500 m/min, preferably more than 1000 m/min.

The circumferential speed of the at least one random roller ranges from more than 100 m/min to about 2000 m/min, preferably from 400 to 1500 m/min. Such an intermediate card allows for production performances of about 400 kg/m/h with light-weight nonwovens of under 30 g/m$^2$. Thus, the invention allows to produce light-weight nonwovens at high production speeds.

In an embodiment of the invention, it is advantageous that a single doffer roller is in engagement with two web-forming rollers, takes over one card web from each roller and doubles the card webs. The doubling occurs immediately downstream of the web-forming rollers so that only a single doffer roller is required.

According to a further embodiment of the intermediate card with a doffer roller each downstream of a web-forming roller, it is provided that a single stuffing roller is in engagement with the two doffer rollers and takes over a card web from each of the doffer rollers and doubles the card webs. In this variant of the invention, the doubling occurs only downstream of the doffer device, at the first stuffing roller of a stuffing device. In this embodiment, the number of machine elements required is also reduced, as only one take-off device and a single transport belt is required downstream of the doffer device. This embodiment is also especially well suited for producing light doubled fibrous webs at a high production speed.

A further embodiment of the intermediate card comprises a web-forming roller in engagement with and rotating in the same sense as the main cylinder as well as a doffer roller also used as a web-forming roller and rotating in the opposite sense to the main cylinder. The random roller and the doffer roller each take off a web from the main cylinder, the web-forming roller being associated with a doffer roller rotating in the opposite sense. A single stuffing roller is in engagement with the two doffer rollers and takes over a card web from each of the two doffer rollers, which is doubled on the stuffing roller. This embodiment allows for cross-linking two structurally different cards by a stuffing process.

A variant of the latter embodiment consists in the stuffing device comprising two first stuffing rollers, each in engagement with a doffer roller, the card webs being doubled on a second stuffing roller in engagement with the two first stuffing rollers.

A further advantage of the embodiments described is that more space for pairs of worker rollers or fixed carding segments is provided on the circumference of the main cylinder. In a further development of the invention with at least one web-forming roller downstream of the main cylinder and at least one doffer roller downstream of this web-forming roller, it is provided that the doffer roller is in engagement with both at least one web-forming roller and the main cylinder, takes over a card web from each roller and doubles the card webs.

In such an intermediate card, the number of the machine elements required is reduced still further, the card webs being doubled on the single doffer roller taking over a card web directly from the main cylinder and a further card web from the web-forming roller in engagement with the main cylinder.

Thus, the doffer roller takes over the function of the web-forming roller, on the one hand, and the function of doubling two differently produced card webs. Therefore, the production process only requires one web-forming roller, e. g. a random roller, and a single doffer roller, whereby another roller can be saved in comparison to the aforementioned embodiments.

It is understood that a further random roller, for instance, can be in engagement both with the main cylinder and the doffer roller, whereby the three card webs from the doffer roller can be doubled.

Further advantageous characteristics are described in the subclaims.

Embodiments of the invention will now be described with reference to the accompanying drawings.

Figure 2A:
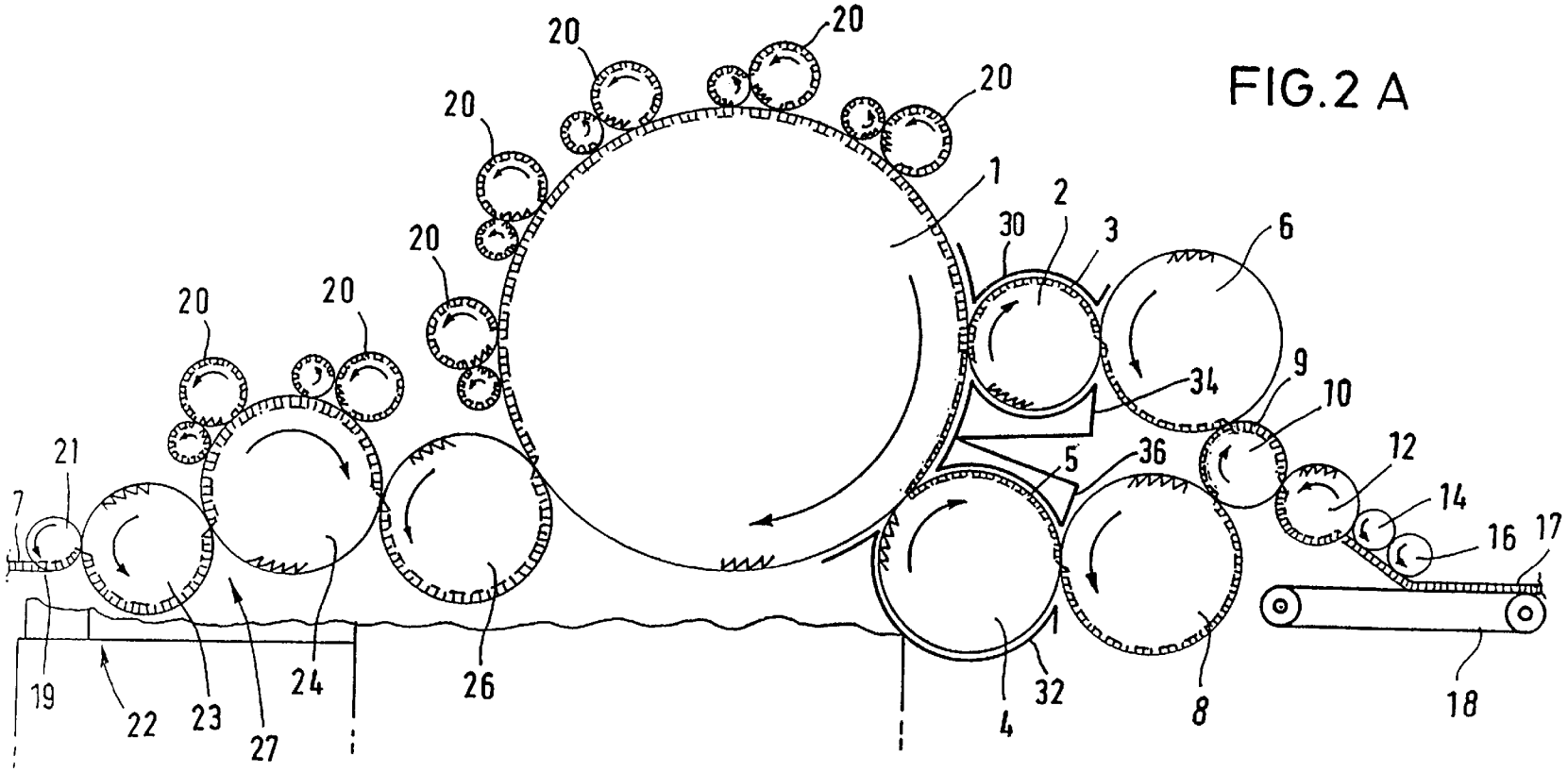
Figure 2B:
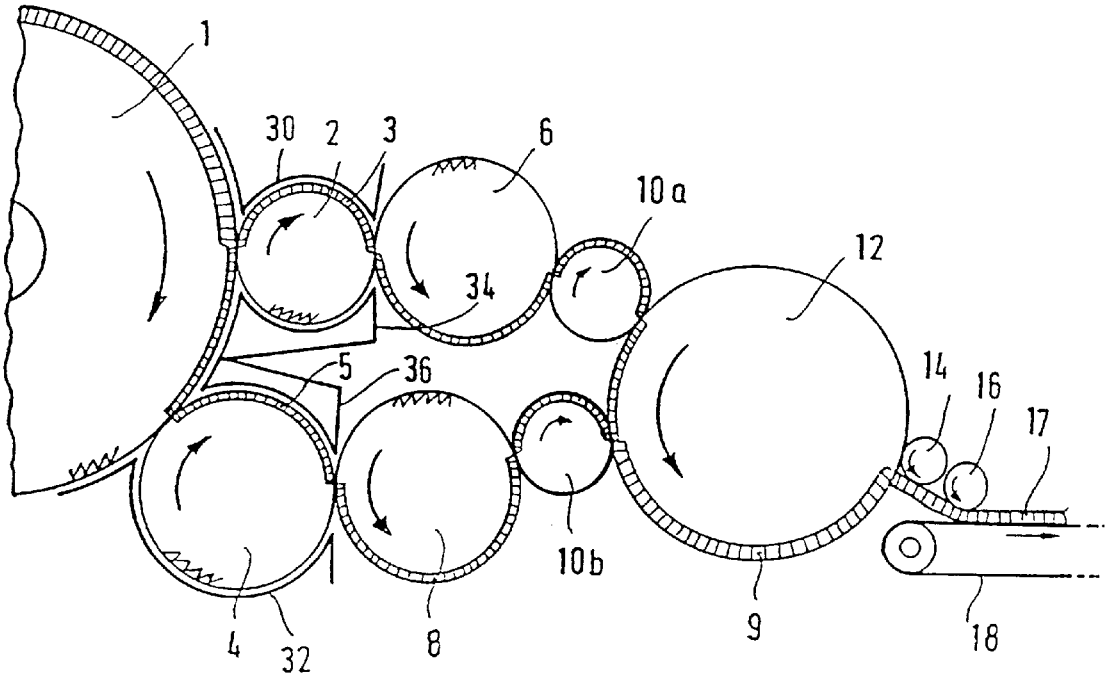
Figure 3:
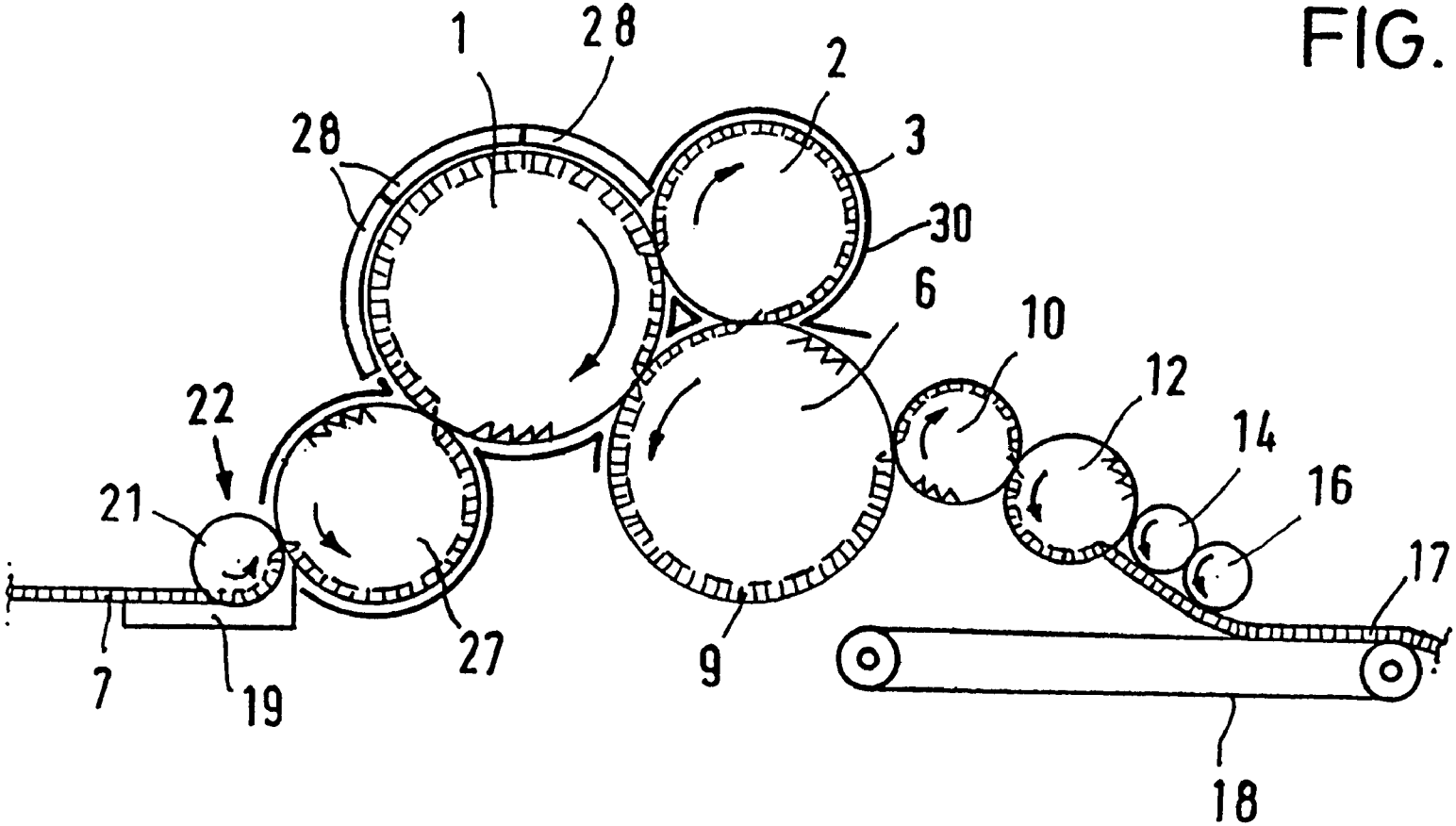
Figure 4:
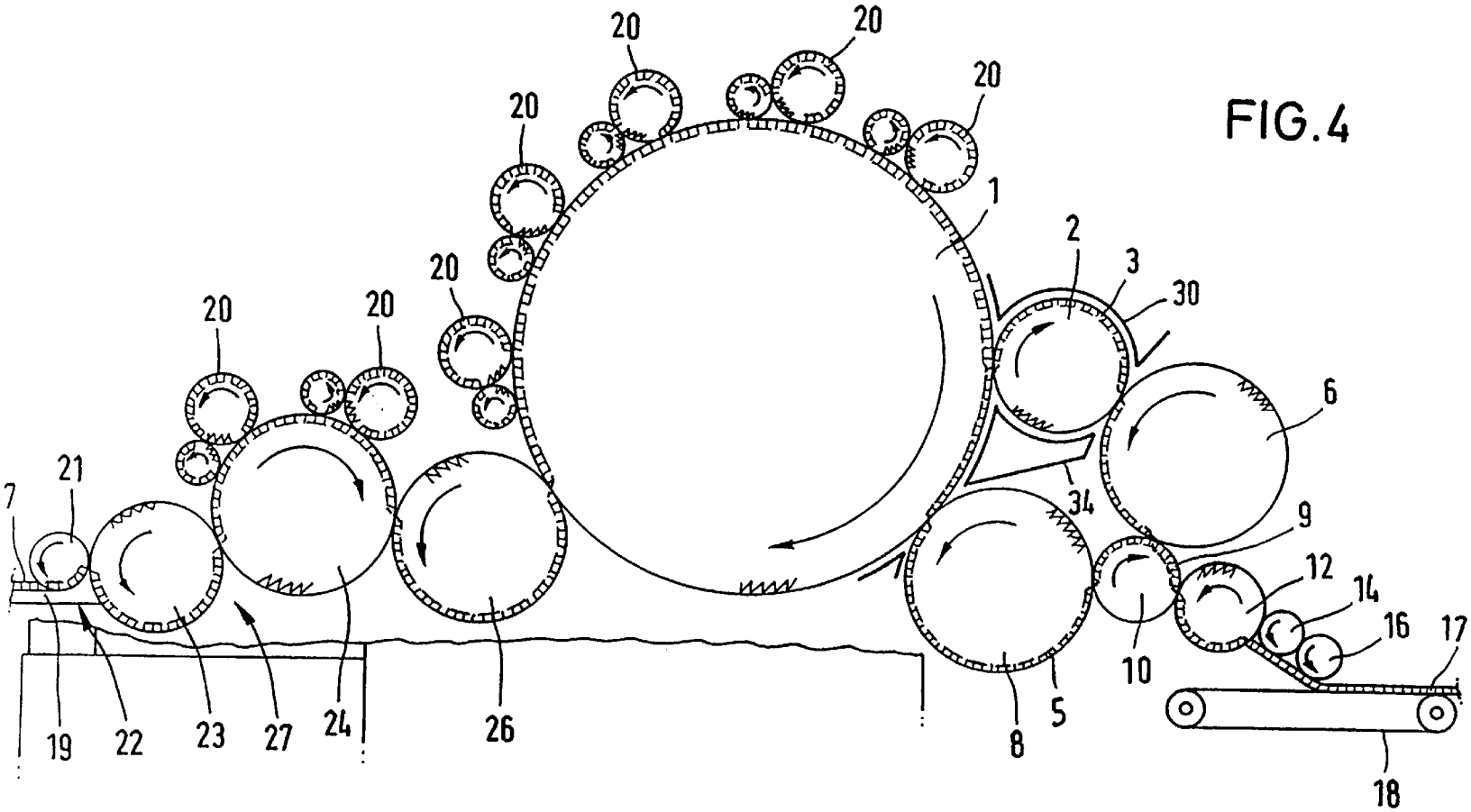

FIG. 1 shows a first embodiment of an intermediate card according to the invention, FIG. 2A shows a further embodiment in which two randomly oriented webs are closely cross-linked in a stuffing process, FIG. 2B shows a variant of FIG. 2A, FIG. 3 shows a third embodiment in which two structurally different webs are closely cross-linked by the individual fibers being cross-linked, and FIG. 4 shows a fourth embodiment in which two structurally different webs are closely cross-linked through a stuffing process.

FIG. 1 shows a first embodiment of an intermediate card with a drawing-in device 22 consisting of a drawing-in trough 19 and a drawing-in roller 21.

The licker-in device 27 downstream thereof consists of a licker-in 23 and a licker-in drum 24. The licker-in drum 24 is provided with two pairs of worker and clearer rollers 20.

Arranged downstream thereof is a transfer roller 26 transferring a card web 7 supplied to a main cylinder 1.

The main cylinder 1 is provided with five pairs of worker and clearer rollers 20. In the rotational direction downstream of the pairs of worker and clearer rollers 20, two web-forming random rollers 2, 4 are in engagement with the main cylinder 1 in the rotational direction and each take off a card web 3, 5 from the main cylinder 1. A single doffer roller 6 takes over the two card webs 3, 5 from the random rollers 2, 4 and doubles them so that a doubled card web 9 is transferred to a stuffing device 10, 12 downstream thereof and a take-off device 14, 16 arranged downstream of the stuffing device 10, 12. A doubled fibrous web 17 gets from the take-off device 14, 16 onto a transport belt 18.

In the embodiment of FIG. 1, in the case of the combination of two random rollers 2, 4 with only one single doffer roller 6, the random rollers can be arranged close to each other, whereby more space is provided on the circumference of the main cylinder for an additional pair of worker and clearer rollers 20. In the case of an additional pair of worker and clearer rollers 20, the carding performance can be increased.

The random rollers 2, 4 comprise, in the rotational sense thereof, stationary trough plates 30, 32, 36. The space between random roller 2, 4 and the trough plates 30, 36 forming a centrifugal trough tapers in the working direction, the through plate upstream of the connecting line between the central points of the random rollers 2, 4 and the doffer roller 6 ending in a distance of a predetermined length to form a free nonwoven forming zone. The indentation of the fittings of the random rollers 2, 4 comprises a front rake of only a few degrees of angle, preferably about 11°.

FIG. 2A shows a second embodiment with a doffer roller 6, 8 being provided for each random roller 2, 4, the two doffer rollers 6, 8 transferring their card web 3, 5 to a common stuffing roller 10 of the stuffing device 10, 12 so that the card webs 3, 5, as opposed to the embodiment initially described, are not doubled in the doffer stage but immediately afterwards.

The random rollers 2, 4 are associated with trough plates 32, 34 and trough plates 30, 36 forming centrifugal troughs The distance. between trough plates 30, 36 to the random rollers 2, 4 decreases in The direction towards the location of transfer to the doffer rollers 6, 8. This reduction of the distance of the trough plates 30, 36 leads to a stuffing effect in the tapering space between the random roller 2, 4 and the trough plate 30, 36. Immediately before the transfer of the webs 3, 5 to the doffer roller 6, 8, the stuffing effect is abruptly neutralized, whereby it is achieved to loosen a part of the fibers from the fittings and subsequently to form a random laid web on the doffer roller 6, 8.

The circumferential speed of the main cylinder 1 amounts to more than 500 m/min, preferably more than 1000 m/min, while the circumferential speed of the random roller 2, 4 preferably ranges from 400 and 1500 m/min.

The web-forming rollers 2, 4, preferably both random rollers, can have a different rotational speed or a different diameter, whereby the properties of the card webs 3, 5 to be doubled can be influenced. In the embodiments of FIGS. 1 and 2, the main cylinder 1 is preferably larger than the web-forming rollers 2, 4.

In this case, the doffer rollers 6, 8 preferably also have a larger diameter than the web-forming rollers 2, 4.

FIG. 2B is a variant of the second embodiment in which each card web 3, 5 is initially transferred to a stuffing roller 10*a*, 10*b* of the stuffing device 10, 12, with the card webs 3, 5 being doubled on the common second stuffing roller 12. The common second stuffing roller 12 of the stuffing device 10, 12 comprises a larger diameter than the first stuffing rollers 10*a*, 10*b* and preferably also a larger diameter than the diameter of the doffer rollers 6, 8.

The third embodiment represented in FIG. 3 shows an intermediate card with a drawing-in device 22, a main cylinder 1 with carding segments 28, a web-forming random roller 2 with a trough plate 30 and a doffer roller 6, at the same time in engagement with the random roller 2 and the main cylinder 1. The single doffer roller 6 both takes over a random laid card web from the random roller 2 as well as fibers from the main cylinder 1 so that two card webs 3, 5 are again doubled on a single doffer roller at the same time serving as a web-forming roller. According to the embodiment of FIG. 1, the doubled card web 9 is transferred, via a stuffing device 10, 12 and a take-off device 14, 16, to a transport belt 18.

In this embodiment, the doffer roller 6 can have a diameter substantially equal to the one of the main cylinder 1. When the doubled card web 9 is taken off as shown in FIG. 3, the intermediate card according to the third embodiment produces a closely cross-linked fibrous web 17, the bottom side thereof consisting of a longitudinally directed web and the top side thereof consisting of a random laid web.

The size of the doffer roller 6, 8 influences the random laid layer. The random roller 2 and the doffer roller 6 are adjustable, what the position thereof, i. e. the mutual distance thereof and the distance thereof to the main cylinder 1 is concerned.

Instead of the carding segments 28, pairs of worker and clearer rollers 20 can be provided, such as in the embodiments of FIGS. 1 and 2.

The fourth embodiment represented in FIG. 4 shows an intermediate card, the general construction thereof up to the main drum 1 corresponding to the embodiments of FIGS. 1 and 2. A random roller 2 rotating in the same sense as the main drum 1 as well as a doffer roller 8 separate from the random roller 2 and rotating in the opposite sense to the main drum 1 are in engagement with the main drum 1. The doffer roller 8 is also used as a web-forming roller. A doffer roller 6 taking over the card web 3 from the random roller 2 is provided downstream of the random roller 2. Both the doffer rollers 6, 8 transfer their card web 3, 5 to a common stuffing roller 10 of the stuffing device 10, 12. Therefore, the card webs 3, 5 are doubled immediately downstream of the doffer stage in this embodiment as well. This embodiment also allows to cross-link two structurally different webs through a stuffing process.

We claim:

1. Intermediate card for producing a web of fibrous material, comprising a main cylinder (1), two web-forming rollers (2, 4; 2, 6) in engagement with the main cylinder (1), each taking off one card web from the main cylinder (1), wherein at least one of the web-forming rollers (2, 4) in engagement with said main cylinder (1) is a random roller for producing a random orientation of the card web (3, 5) with an associated trough plate (30, 36) forming a centrifugal trough the random roller and its associated trough plate separated by a space, and wherein the space between the random roller and the trough plate tapers toward a discharge end causing a stuffing effect on the web, the trough plate ending in a distance of a predetermined length to form a free nonwoven forming zone, the random roller having an indentation with a front rake forming an acute angle, a doffer device (6, 8) downstream of and in engagement with the web-forming rollers (2, 4; 2, 6), a common roller (6, 10, 12) cross-linking at least two card webs (3, 5) to a single web (9) taken from the main cylinder (1) by the web-forming rollers (2, 4; 2, 6), and a take-off device (14, 16) for taking off the single web (9) at the end of the card.

2. Intermediate card according to claim 1, characterized in that the circumferential speed of the main cylinder (1) amounts to more than 500 m/min, preferably to more than 1000 m/min.

3. Intermediate card according to claim 1 or 2, characterized in that the circumferential speed of the at least one random roller (2, 4) ranges from more than 100 m/min to about 2000 m/min, preferably from 400 to 1500 m/min.

4. Intermediate card according to any one of claims 1 or 2, characterized in that two web-forming rollers (2, 4) in engagement with and rotating in the same sense as the main cylinder (1), and being independent of each other, each take off one card web (3, 5) from the main cylinder (1), and in that a single doffer roller (6) of the doffer device is in engagement with the two web-forming rollers (2, 4), takes over one card web (3, 5) each from the two rollers (2, 4) and doubles the card webs (3, 5).

5. Intermediate card according to any one of claims 1 or 2, characterized in that two web-forming rollers (2, 4) in engagement with and rotating in the same sense as the main cylinder (1), and being independent of each other each take off one card web (3, 5) from the main cylinder (1), in that each web-forming roller (2, 4) is associated with a doffer roller (6, 8) rotating in the opposite sense, and in that a single stuffing roller (10) is in engagement with both the doffer rollers (6, 8) and takes over one card web (3, 5) each from the two doffer rollers (6, 8) and doubles the card webs.

6. Intermediate card according to any one of claims 1 or 2, characterized in that a random roller (2) in engagement with and rotating in the same sense as the main cylinder (1) and a doffer roller (8) also used as a web-forming roller and rotating in the opposite sense to the main cylinder (1) each take off a web from the main cylinder, in that the web-forming roller (2, 4) is associated with a doffer roller (6, 8) rotating in the opposite sense, and in that a single stuffing roller (10) takes over, by means of the two doffer rollers (6, 8), a card web (3, 5) each and doubles the card webs.

7. Intermediate card according to any one of claims 1 or 2, characterized in that the web-forming rollers (2, 4) have different rotational speeds.

8. Intermediate card according to any one of claims 1 or 2, characterized in that the web-forming rollers (2, 4) have different diameters.

9. Intermediate card according to any one of claims 1 or 2, characterized in that the main cylinder (1) has a larger diameter than the web-forming rollers (2, 4).

10. Intermediate card according to any one of claims 1 or 2, characterized in that the doffer device consists of a single doffer roller (6) also used as a web-forming roller (2, 6) and rotating in the opposite sense to the main cylinder (1), and in that the doffer roller (6) is in engagement with both the random roller (2) and the main cylinder (1), takes over one card web (3, 5) each from the two rollers (1, 2) and doubles the card webs.

11. Intermediate card according to claim 10, characterized in that the doffer roller (6) has a diameter substantially equal to that of the main cylinder (1).

12. Intermediate card according to any one of claims 1 or 2, characterized in that at least one doffer roller (6, 8) has a larger diameter than the web-forming rollers (2, 4).

13. Intermediate card according to any one of claims 1 or 2, characterized in that a stuffing device (10, 12) is arranged between the doffer device (6) and the take-off device (14, 16).

14. Intermediate card according to any one of claims 1 or 2, characterized in that two web-forming rollers (2, 4) in engagement with and rotating in the same sense as the main cylinder (1), and being independent of each other each take off one card web (3, 5) from the main cylinder (1) and transfer it to one doffer roller (6, 8) of the doffer device each, in that a stuffing device (10, 12) is arranged between the doffer device (6) and the take-off device (14, 16), and in that a first stuffing roller (10) takes over the card webs (3, 5) from the stuffing device (10, 12) and doubles the card webs.

15. Intermediate card according to any one of claims 1 or 2, characterized in that two web-forming rollers (2, 4) in engagement with and rotating in the same sense as the main cylinder (1), and being independent of each other each take off one card web (3, 5) from the main cylinder (1) and transfer it to one doffer roller (6, 8) of the doffer device each, in that a stuffing device (10, 12) is arranged between the doffer device (6) and the take-off device (14, 16), in that the stuffing device (10, 12) comprises two first stuffing rollers **(10*a*, 10*b*), each in engagement with a doffer roller (6, 8), and in that a second stuffing roller (12) of the stuffing device takes over the card webs (3, 5) from the first stuffing roller (10*a*, 10*b*)** and doubles the card webs.

16. Intermediate card according to any one of claims 1 or 2, characterized in that all the web-forming rollers (2, 4) are random rollers.

17. Process for producing a nonwoven of fibrous material by means of an intermediate card comprising the steps of:

carding the fibrous material on a main cylinder (1) in a carding step, taking off at least two card webs (3,5) from the main cylinder (1) by means of at least two rollers (2, 4, 2, 6; 2, 8) independent of each other in a web-forming stage, producing a random orientation of at least one card web (3, 5) between the main cylinder (1) and the at least one doffer device (6, 8) by using at least one web-forming random roller (2, 4) producing a random orientation of the card web (3, 5) and with a centrifugal trough (30, 36) associated with each random roller (2, 4), subjecting the card web (3, 5) initially to a stuffing effect by reducing the space between the random roller (2, 4) and the trough plates (30, 36) in a working direction and then the card web being suddenly released from the stuffing pressure in a free nonwoven forming zone immediately before taking over the webs in a doffer stage, taking over the card webs (3, 5) in the doffer stage by means of a doffer device (6), joining the card webs (3, 5) formed in the web-forming stage by uniting the card webs (3, 5) on a common roller to form a cross-linked card web (9), and taking off the card webs (3, 5) after the doffer stage.

18. Process according to claim 17, and further joining the card webs (3, 5) transferred by the rollers (2, 4) on a doffer roller (6) common to all the web-forming rollers (2, 4).

19. Process according to claim 17, and further stuffing the card webs (3, 5) taken over by the doffer device with two doffer rollers (6, 8) and by doubling the card webs (3, 5) transferred by the doffer rollers (6, 8) on a stuffing roller (10) common to the two doffer rollers (6, 8).

20. Process according to claim 19, and further doubling a card web (3) taken over from the main cylinder (1) by the web-forming roller (2) with a card web (5) taken over directly from the main cylinder (1) by the doffer device (6) at the same time used as a web-forming roller on the doffer device (6).

21. Process according to claim 17, and further stuffing the card webs (3, 5) taken over by the doffer device with two doffer rollers (6, 8), by means of a first stuffing roller (**10*a*, 10*b*) each in engagement with a doffer roller (6, 8) each and by doubling the card webs (3, 5) transferred by the first stuffing rollers (10*a*, 10*b*) on a single stuffing roller (12) common to the two first stuffing rollers (10*a*, 10*b***).

22. Process according to claim 17, and further doubling a card web taken over from the main cylinder (1) and transferred to a doffer roller (6) by a web-forming random roller (2) with a card web taken over directly from the main cylinder (1) by a further doffer roller (8) at the same time used as a web-forming roller on a stuffing roller (10) common to the two doffer rollers (6, 8).

* * * * *

UNITED STATES PATENT AND TRADEMARK OFFICE

CERTIFICATE OF CORRECTION

PATENT NO : 6,073,313
DATED : June 13, 2000
INVENTOR(S) : Lesenga et al.

It is certified that error appears in the above-identified patent and that said Letters Patent is hereby corrected as shown below:

Claim 1, line 5: insert --roller-- after "each"; delete "taking off" and insert --removing--

, line 9: insert --,-- after "(3, 5)"; delete "with"

, line 10: insert --in conjunction with the roller,-- after "plate"; insert --trough plate-- after "36)"

, line 11: change "its" to --the--

, line 14: change "on" to --of--

, line 21: delete "a common roller (6, 10, 12) cross-linking" and insert --the doffer device removes the webs from the web forming roller and cross-links--

Claim 2, lines 3-4: delete ", preferably to more than 1000 m/min"

Claim 3, line 4: delete ", preferably from 400 to 1500 m/min"

Claims 4, 14 and 15, line 3: change "sense" to --direction--

Claim 5, lines 3 and 7: change "sense" to --direction--

Claim 6, lines 3, 5 and 8: change "sense" to --direction--

Claim 10, line 4: change "sense" to --direction--

UNITED STATES PATENT AND TRADEMARK OFFICE

CERTIFICATE OF CORRECTION

PATENT NO. : 6,073,313
DATED : June 13, 2000
INVENTOR(S) : Lesenga et al.

It is certified that error appears in the above-identified patent and that said Letters Patent is hereby corrected as shown below:

Claim 17, line 9: delete "the" after "and"

Signed and Sealed this

Twenty-sixth Day of December, 2000

*Attest:*

Q. TODD DICKINSON

*Attesting Officer*

*Director of Patents and Trademarks*